US006597263B2

(12) United States Patent
Jun et al.

(10) Patent No.: US 6,597,263 B2
(45) Date of Patent: Jul. 22, 2003

(54) DIELECTRIC FILTER HAVING NOTCH PATTERN

(75) Inventors: Dong-Suk Jun, Taejon (KR); Bon-Hee Koo, Taejon (KR); Chang-Hwa Lee, Taejon (KR); Oh-Gone Chun, Taejon (KR); Sang-Seok Lee, Taejon (KR)

(73) Assignees: Electronics and Telecommunications Research Institute, Taejon (KR); Korea Electronics Co., Kumi (KR)

( * ) Notice: Subject to any disclaimer, the term of this patent is extended or adjusted under 35 U.S.C. 154(b) by 9 days.

(21) Appl. No.: 09/749,797

(22) Filed: Dec. 28, 2000

(65) Prior Publication Data

US 2001/0008388 A1 Jul. 19, 2001

(30) Foreign Application Priority Data

Jan. 19, 2000 (KR) ..... 2000-2437

(51) Int. Cl.[7] ..... H01P 1/201
(52) U.S. Cl. ..... 333/202; 333/206
(58) Field of Search ..... 333/206, 202, 333/202 DB

(56) References Cited

U.S. PATENT DOCUMENTS

| | | | | |
|---|---|---|---|---|
| 4,740,765 A | | 4/1988 | Ishikawa et al. | 333/206 |
| 4,823,098 A | | 4/1989 | DeMuro et al. | 333/206 |
| 5,227,747 A | | 7/1993 | Komazaki et al. | 333/206 |

FOREIGN PATENT DOCUMENTS

| | | | | |
|---|---|---|---|---|
| GB | 2271471 | * | 4/1994 | 333/202 DB |
| JP | 5175708 | * | 7/1993 | 333/202 DB |
| JP | 6216607 | * | 8/1994 | 333/206 |
| JP | 07-336108 | | 12/1995 | H01P/1/205 |

OTHER PUBLICATIONS

Matsumoto et al.; *A Miniaturized Dielectric Monoblock-bank–Pass Filter for 800MHz Band Cordless Telephone System*; 1994 IEEE MTT–S Digest; pp. 249–252.

Ishizaki et al.; A Stepped Impedance Comb–Line Filter Fabricated by Using Ceramic Lamination Technique; 1994 IEEE MTT–S Digest; pp. 617–620.

* cited by examiner

*Primary Examiner*—Benny Lee
(74) *Attorney, Agent, or Firm*—Jacobson Holman PLLC

(57) ABSTRACT

A dielectric filter having a notch pattern includes a dielectric block, in which a ground face plated with conductive metal for all the rest portions excepting an upper face thereof and both side given portions of one side wall face connected to the upper face is formed and numerous patterns plated with the conductive metal are formed on the upper face as a non-conductive part, input electrode provided on one portion out of non-conductive portions and formed so that a signal from the outside may be inputted thereto, at least two resonators formed piercing through upper and lower faces of the dielectric block, a lower end part of which is short-circuited on a lower face as the ground face of the dielectric block, wherein two resonators are connected with each other through a pattern formed on the upper face of the dielectric block in order to resonate and wave-transfer a signal inputted through the input electrode, and output electrode provided in the rest one portion out of the non-conductive portions on one side wall face of the dielectric block, the output electrode being for outputting a signal resonated in each resonator to the outside.

16 Claims, 5 Drawing Sheets

DIELECTRIC FILTER HAVING NOTCH PATTERN

FIELD OF THE INVENTION

The present invention relates to a dielectric filter installed in a terminal of a radio communication system; and, more particularly, to a dielectric filter having a notch pattern, in which an attenuation characteristic on a stop band can be improved and simultaneously a coupling quantity control between respective resonators can become easy, by gaining a high attenuation pole even without increasing the number of resonators.

PRIOR ART OF THE INVENTION

It is known that in order to improve frequency efficiency in the terminals of a radio communication system, mutually neighboring transmission and reception frequency bands may be used, such that a high attenuation characteristic on a stop band is required in a filter used in such terminals.

Referring to FIGS. 1 through 3, a dielectric filter based on first through third embodiments of a conventional technique may be described as follows.

The dielectric filter based on the first embodiment of the conventional technique shown in FIG. 1 includes a dielectric block 10 and first through sixth resonators 11, 12, 13, 14, 15 and 16 which are formed, piercing through upper and lower faces of the dielectric block 10.

Each resonator 11 through 16 is formed by plating an inner wall face of a through-hole with conductive metal, the through-hole being formed by piercing through the upper and lower faces of the dielectric block 10. All the wall faces of the dielectric block 10 except the upper face are plated with the conductive metal. The upper face of the dielectric block 10 is electrically opened, and the rest of the wall faces, except the upper face, of the dielectric block 10 are formed as ground faces.

On the upper face of the dielectric block 10, a plurality of slots 17 for controlling a coupling quantity between two resonators formed adjacently to each other, and a reactance 18 for improving an attenuation characteristic on a stop band of the dielectric filter are formed. An inner wall face of each slot 17 is plated with conductive metal, and the coupling quantity between the resonators of the filter can be controlled by controlling a size of the slot 17. The reactance 18 connects two resonators, namely, a second resonator 12 with a fifth resonator 15, and resonators 13, 14 not connected by the reactance 18 exist between two resonators, namely, the second and fifth resonators 12, 15, which are connected by the reactance 18. This reactance 18 is composed of coil, a capacitor and a lead wire etc.

The dielectric filter based on the second embodiment of the conventional technique shown in FIG. 2 includes a dielectric block 20 having a formation of first through seventh resonators 21, 22, 23, 24, 25, 26 and 27 which are formed, piercing through upper and lower faces thereof.

A first transmission line 28 having an electric length of $\lambda/4$ is formed between the first and second resonators 21, 22, $\lambda$ being a wavelength of resonance frequency. Also, a second transmission line 29 having an electric length of $\lambda/4$ is formed between the second and third resonators 22, 23. Such a conventional dielectric filter has numerous attenuation pole characteristic through an inverter circuit. At this time, a magnetic field coupling is formed between the respective resonators, and such respective resonators are separately tuned so as to have a desired filter characteristic.

If the dielectric filter based on the second embodiment of the conventional technique is applied to a duplexer, a plurality of resonance polar points can be formed by forming numerous holes.

The dielectric filter based on the third embodiment of the conventional technique shown in FIG. 3 includes a dielectric block 30 in which an electric opening face is formed on an upper face thereof, and on its side wall and lower face, ground faces plated with the conductive metal are formed, and in which first through fourth resonators 31, 32, 33, 34 formed piercing through the upper and lower faces thereof are also provided.

On the upper face of the dielectric block 30 as the opening face, there are formed first through fourth resonator patterns 31*a*, 32*a*, 33*a* and 34*a* connected to upper parts of the respective resonators 31 through 34, and two of first metal patterns 35 provided between the second and third resonator patterns 32*a*, 33*a* and between the third and fourth resonator patterns 33*a*, 34*a*. Both end parts of the first metal pattern 35 are individually connected to both side wall faces as the ground face of the dielectric block 30. Further, a second metal pattern 36 is formed between the first and second resonator patterns 31*a*, 32*a*, and one end part of the second metal pattern 36 is connected to one side wall face of the dielectric block 30, and another end part provides an opening part 37 which is distanced by a constant interval T from another side wall face of the dielectric block 30.

In such conventional dielectric filter, a loading capacitance is formed between the respective metal patterns 35 and the second through fourth resonator patterns 32*a* to 34*a*, and a loading capacitance is also formed between the first and second resonator patterns 31*a*, 32*a*. Herewith, the loading capacitance between the first and second resonator patterns 31*a*, 32*a* is controlled by a size of the opening part 37 formed by the second metal pattern 36. In other words, the loading capacitance between the first and second resonator patterns 31*a*, 32*a* can be controlled by controlling a size of the opening part 37.

In the dielectric filter based on the first embodiment of the conventional technique, more than three resonators must be formed to improve the attenuation characteristic on the stop band by using the reactance, such that the size of the filter is increased and it is difficult to reduce or enlarge a size of a slot that has already been processed. Thus, it is difficult to control a coupling quantity between the resonators after a process of the filter.

Furthermore, in case that the dielectric filter based on the conventional second embodiment is applied to a duplexer, an impedance unbalance unacceptable in an interface of transmission/reception filters occurs from an attenuation pole formed on a pass band end portion of the transmission filter coupled with the reception filter. That is, the number of the attenuation poles is restricted as a transmission zero, to thereby drop a filter characteristic on the stop band, and due to such reasons, some restriction is caused in designing the transmission/reception filters of the duplexer.

In the dielectric filter based on the conventional third embodiment, the coupling quantity can be controlled by controlling a size of the opening part formed by the second metal pattern, but the number of the resonators must be increased to improve the attenuation characteristic on the stop band. Therefore, there is a problem in that the filter becomes large in size.

SUMMARY OF THE INVENTION

Therefore, it is an object of the present invention to provide a dielectric filter having a notch pattern capable of improving an attenuation characteristic on a stop band, without increasing the number of resonators, through an embodiment for gaining a coupling not only between neighboring resonators but also between resonators which are not adjacent to one another, so as to obtain a high attenuation pole on a frequency band adjacent to transmission and reception frequency.

Another object of the present invention is to provide a dielectric filter having a notch pattern capable of easily controlling a coupling between a ground face and a resonator necessary for an operation of a filter and a coupling between a resonator and a resonator.

Still another object of the present invention is to provide a dielectric filter having a notch pattern capable of miniaturizing a filter without increasing the number of resonators.

In accordance with the present invention for achieving the above objects, the dielectric filter having a notch pattern includes a dielectric block in which a ground face plated with conductive metal for all the portions of the block except an upper face thereof and two side portions of one side wall face connected to the upper face is formed, and a plurality of resonator patterns and a plurality of metal patterns plated with the conductive metal are formed on the non-conductive upper face, with the resonator patterns being separated from the metal patterns by predetermined distances. An input electrode is provided on one of the non-conductive side portions and formed so that a signal from the outside may be inputted thereto, and at least two resonators are formed piercing through upper and lower faces of the dielectric block, a lower end part of such resonators being short-circuited with a lower face as the ground face of the dielectric block. Two resonators are connected with each other through a pattern formed on the upper face of the dielectric block in order to resonate and wave-transfer a signal inputted through the input electrode, and an output electrode is provided in the remaining non-conductive side portion on one side wall face of the dielectric block, the output electrode being for outputting a signal resonated in each resonator to the outside.

BRIEF DESCRIPTION OF THE DRAWINGS

The above and other objects and features of the instant invention will become apparent from the following description of preferred embodiments taken in conjunction with the accompanying drawings, in which.

A DETAILED DESCRIPTION OF THE PREFERRED EMBODIMENT OF THE INVENTION

Hereinafter, preferred embodiments of the present invention will be described in detail with reference to the accompanying drawings.

In accordance with the present invention, the preferred embodiments for a dielectric filter having a notch pattern are described in detail as follows.

Figure 1:
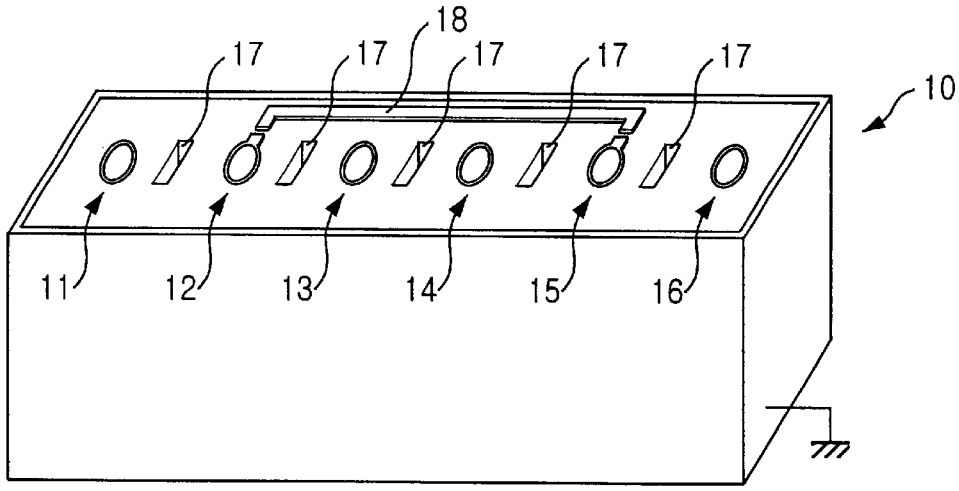
FIG. 1 (PRIOR ART)
FIG. 1 illustrates a perspective view showing a first embodiment of a dielectric filter based on a conventional technique.
Figure 2:
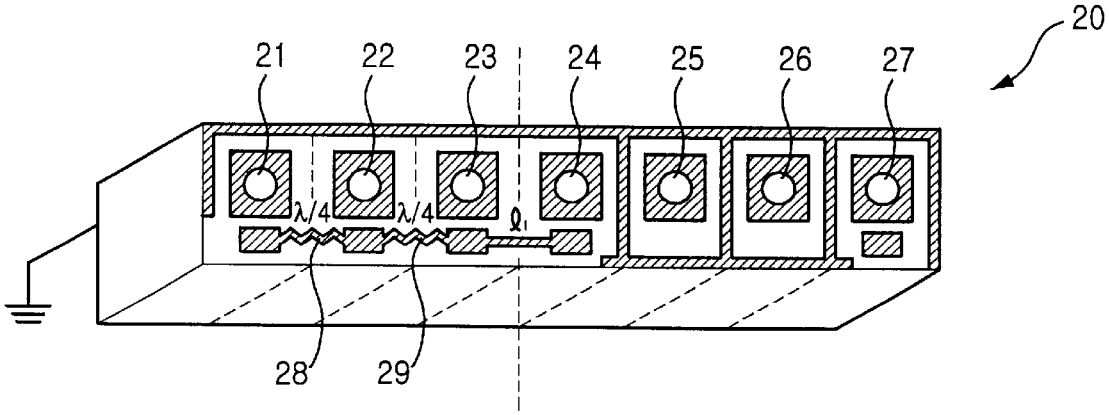
FIG. 2 (PRIOR ART)
FIG. 2 represents a perspective view for a second embodiment based of a dielectric filter based on the conventional technique.
Figure 3:
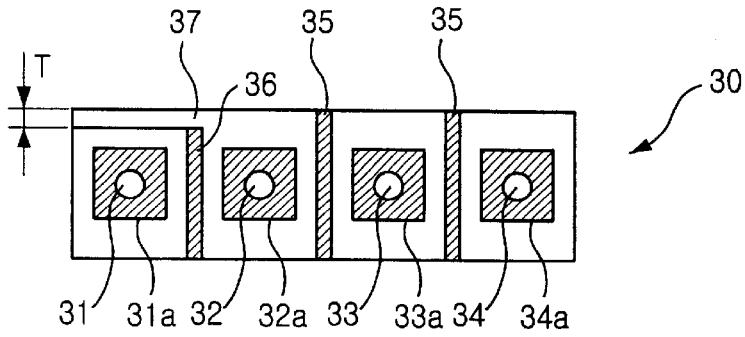
FIG. 3 (PRIOR ART)
FIG. 3 is a plane view showing a third embodiment of a dielectric filter based on the conventional technique.
Figure 4:
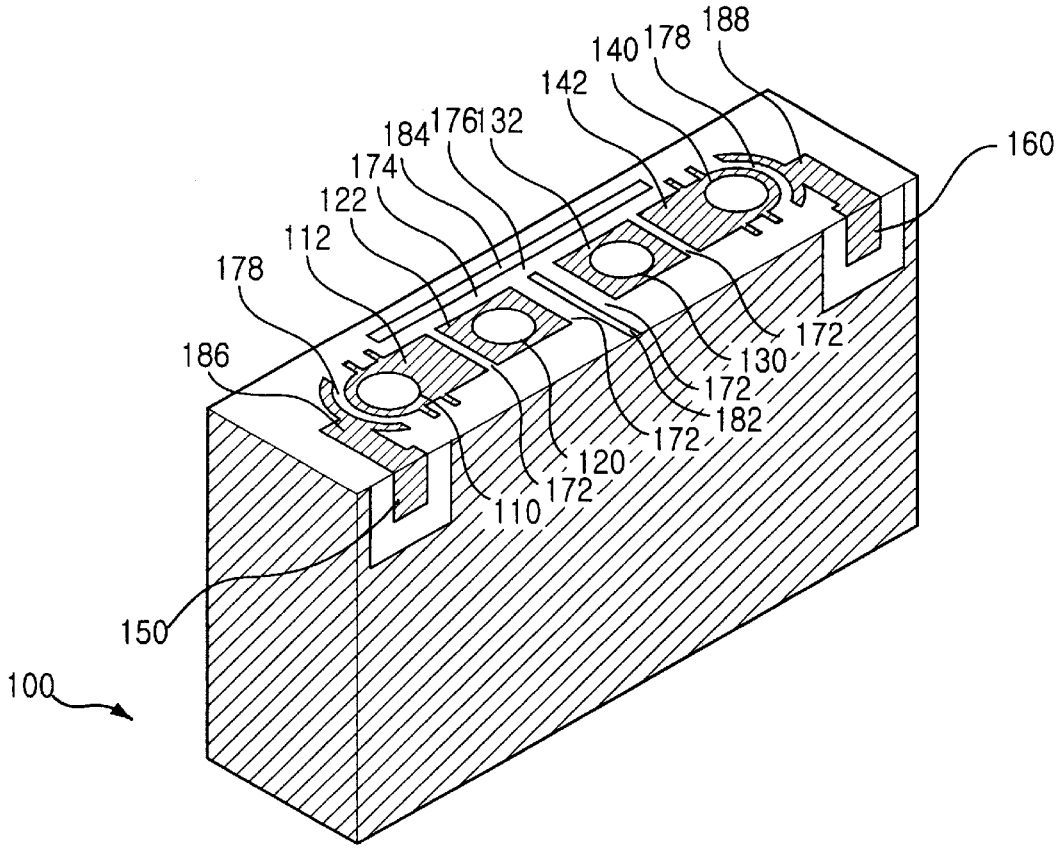
FIG. 4 is a perspective view providing a first preferred embodiment of a dielectric filter having a notch pattern in accordance with the present invention.

As shown in FIG. 4, the dielectric filter having a notch pattern includes a dielectric block 100 plated with conductive metal for all the parts except an upper face thereof and two side portions on one side wall face connected to the upper face; first through fourth resonators 110, 120, 130, 140 formed piercing through upper and lower faces of the dielectric block 100; and input electrode and output electrode 150, 160 respectively, equipped in the side portions not plated with the conductive metal, the side portions being on one side wall face of the dielectric block 100.

The respective resonators 110 through 140 are formed by plating, with the conductive metal, inner wall faces of holes which are formed, piercing through the upper and lower faces of the dielectric block 100. An overall lower face and a constant portion of the side wall face of the dielectric block 100 are plated with the conductive metal, thus are provided as a ground face. According to that, lower parts of the respective resonators 110 through 140 provide a short-circuited end electrically connected to the lower face of the dielectric block 100 plated with the conductive metal.

In this case, on the upper face of the dielectric block 100, first through fourth resonator patterns 112, 122, 132, 142 individually connected to upper end outer circumferences of the resonators 110 through 140 are formed, and the respective resonator patterns 112 through 142 are distanced from one another to form a plurality of first opening parts 172 opened electrically between them. Herewith, a first metal pattern 182 based on a given length is formed in the first opening part 172 between the second and third resonator patterns 122, 132. The first metal pattern 182 is extended from one side wall face of the dielectric block 100 to a given portion of the dielectric block 100 upper face, with one end part being opened electrically and another end part being connected to the ground face. On the upper face of the dielectric block 100, a second metal pattern 184 extending from one side of the first resonator pattern 112 to one side of the fourth resonator pattern 142 is formed. The second metal pattern 184 is distanced by a given interval from the respective resonator patterns 112 through 142 and the first metal pattern 184 is distanced by a given interval from the respective resonator patterns 112 through 142 and the first metal pattern 184, and also form a third opening part 176 between the first metal pattern 182 and the second metal pattern 184.

On one side of the first and fourth resonator patterns 112, 142, each of input and output electrode patterns 186, 188 are distanced by a constant interval from each of patterns 112, 142, respectively. The input electrode pattern 186 formed on one side of the first resonator pattern 112 is connected to input electrode 150, and the output electrode pattern 188 formed on one side of the fourth resonator pattern 142 is connected to output electrode 160. Herewith, a fourth opening part 178 opened electrically is formed between the first resonator pattern 112 and the input electrode pattern 186, and another fourth opening part 178 is formed between the fourth resonator pattern 142 and the output electrode pattern 188. Also, an input capacitance is formed by the fourth opening part 178 between the first resonator pattern 112 and the input electrode pattern 186.

An operation state of the dielectric filter based on the inventive first embodiment is described in detail as follows. In case that a microwave signal is transmitted to the input electrode 150, the microwave signal is field-coupled in the input capacitance, then is wave-transferred to the first resonator 110, and then coincides with frequency of the capacitance formed in the first, second and fourth opening parts 172, 174, 178 of the dielectric block 100 and formed on the ground and with frequency formed by the electric length λ/4 of the first resonator 110, on the neighborhood of the first resonator pattern 112, and at this time, the signal is resonated. A resonance frequency signal of the capacitance formed in the neighborhood of the electric length λ/4 of the first resonator 110 and the first resonator pattern 112 is field-coupled with the second resonator pattern 122, to be wave-transferred to the second resonator 120. The microwave signal resonated in the second resonator 120 is resonated when the signal coincides with frequency of the capacitance formed in the first and second metal patterns 182, 184 and in the second resonator pattern 122, and also with frequency of the electric length λ/4 of the second resonator 120. The resonance frequency signal of the capacitance formed in the neighborhood of the electric length λ/4 of the second resonator 120 and the second resonator pattern 122 is field-coupled with the second resonator pattern 122, to be wave-transferred to the third resonator 130. In such method, the microwave signal is wave-transferred to the third resonator 130 and the third resonator pattern 132, and then, is wave-transferred to the fourth resonator 140 and the fourth resonator pattern 142, to finally be wave-transferred to the output electrode 160.

In such dielectric filter based on the inventive embodiment, in case that the second metal pattern 184 is much smaller than the electric length λ/4 of the first and fourth resonators 110 through 140, the capacitance is formed in the second opening part 174 formed between the second metal pattern 184 and each of the resonator patterns 112, 122, 132, 142, thus an electromagnetic field coupling occurs between the second metal pattern 184 and the ground face, which influences a decision of the resonance frequency. Further, in case that the second metal pattern 184 has the electric length λ/4, the second metal pattern 184 performs an operation as a transmission line. The transmission line operates as one impedance inverter, accordingly, the dielectric filter based on the inventive embodiment can operate as the dielectric filter having a notch characteristic.

Moreover, if the third opening part 176 between the second metal pattern 184 and the first metal pattern 182 formed on the upper face of the dielectric block is narrower than 0.4 mm (millimeters), a steep notch incline on the stop band lower than the pass band results. Conversely, if the third opening part 176 is wider than 0.4 mm, the notch incline on the stop band lower than the pass band becomes gradual.

Similarly, if the first opening part 172 between the second resonator pattern 122 and the first metal pattern 182 formed on the upper face of the dielectric block is narrower then 0.3 mm, a steep notch incline on the stop band higher than the pass band results. Conversely, if the first opening part 172 between the second resonator pattern 122 and the first metal pattern 182 is wider than 0.3 mm, the notch incline on the stop band higher than the pass band becomes gradual.

Figure 5:
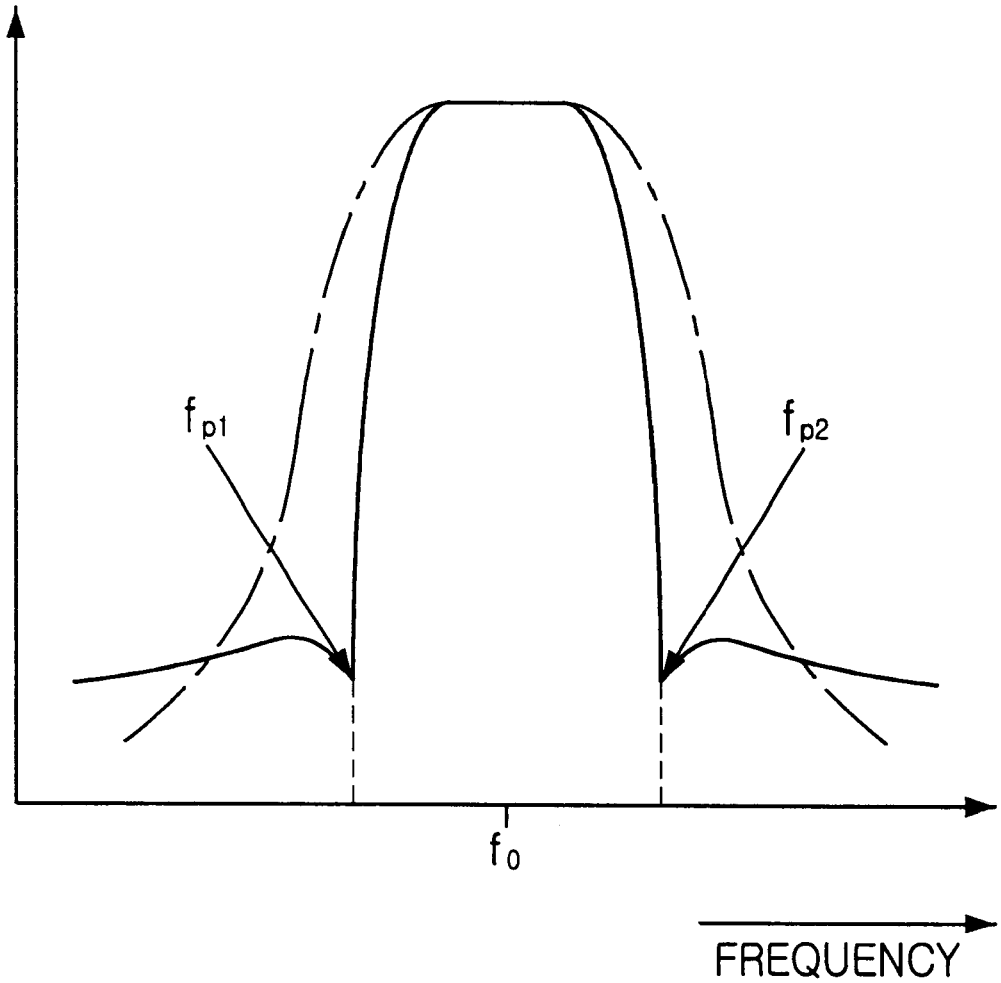
FIG. 5 depicts a graph showing a frequency transfer characteristic of a dielectric filter shown in FIG. 4.

In the dielectric filter having the notch characteristic in accordance with the first embodiment of the present invention in the above-mentioned construction and operation, as shown in FIG. 5, an attenuation pole as frequency fp1 is formed in frequency lower than the pass band, and an attenuation pole as frequency fp2 is formed in frequency higher than the pass band, where $f_0$ is the center frequency and frequency increases in the direction of the arrow. Therefore, a high attenuation characteristic is provided in the neighborhood of the attenuation pole frequency.

Figure 6:
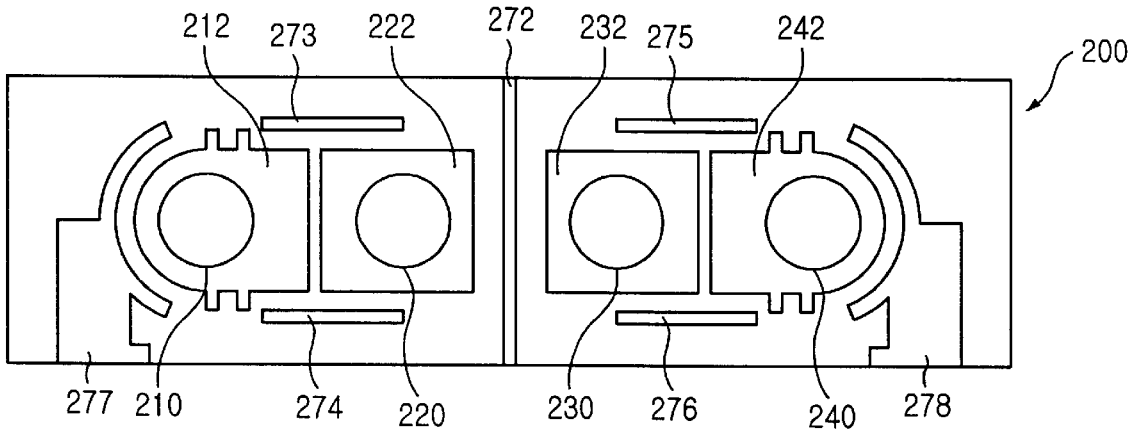
FIG. 6 presents a plane view showing a second preferred embodiment of a dielectric filter having a notch pattern in the present invention.
Figure 7:
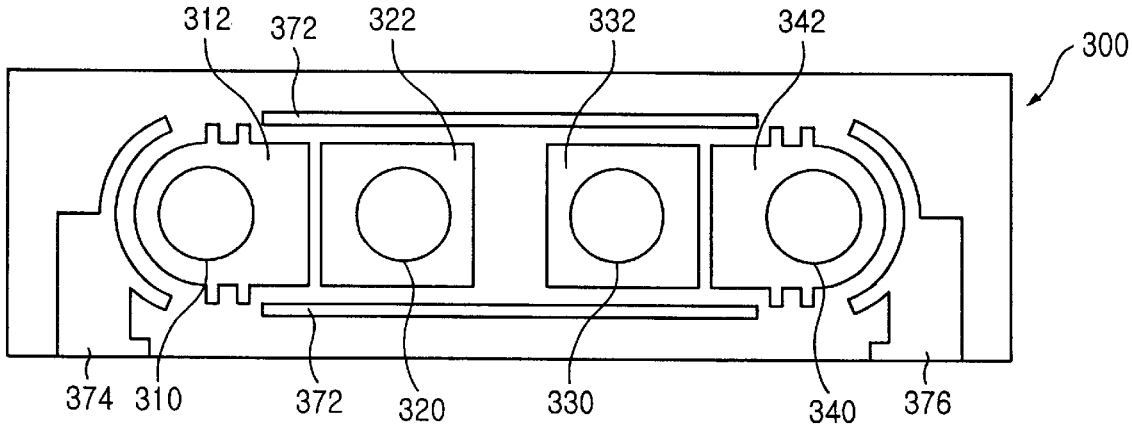
FIG. 7 sets forth a plane view showing a third preferred embodiment of a dielectric filter having a notch pattern in the present invention.
Figure 8:
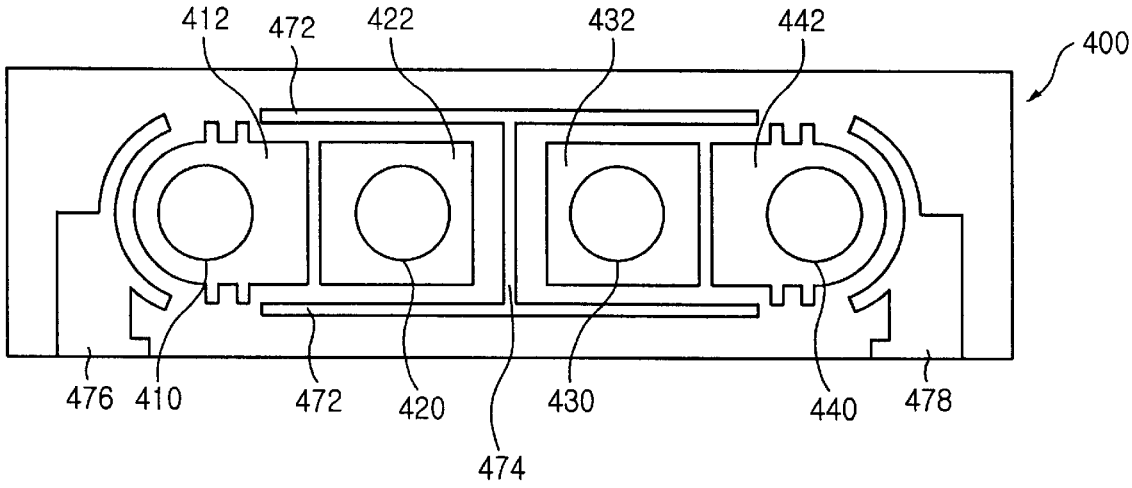
FIG. 8 is a plane view showing a fourth preferred embodiment of a dielectric filter having a notch pattern in the invention.

Meanwhile, the invention is not limited to the above embodiment, but can be constructed by differently providing a shape of patterns formed on the upper face of the dielectric block in the following second through fourth embodiments. With reference to FIGS. 6 through 8, the dielectric filter is described in detail in the second through fourth embodiments of the invention, referring to FIGS. 6 to 8. For reference, a detailed description for the same portions as the first embodiment will be omitted in the following.

As shown in FIG. 6, in the dielectric filter based on the second embodiment of the invention and on the upper face of the dielectric block 200 formed piercing through the upper and lower faces of the first through fourth resonators 210, 220, 230, 240, there are equipped a central metal pattern 272 for partitioning off into the first and second resonator patterns 212, 222 and the third and fourth resonator patterns 232, 242; a pair of third metal patterns 273, 274 formed, being respectively distanced by a constant interval on both sides of the first and second resonator patterns 212, 222; and a pair of fourth metal patterns 275, 276 formed, being respectively distanced by a constant interval on both sides of the third and fourth resonator patterns 232, 242. On one side of each of the first and fourth resonator patterns 212, 242, input and output electrode patterns 277, 278 individually connected to input and output electrode (not shown) are formed, respectively, each resonator pattern being distanced by a given interval from a respective electrode pattern.

Both end parts of the central metal pattern 272 are individually connected to both side wall faces of the dielectric block 200 plated with the conductive metal, to thus cut off the electric field coupling between the second resonator pattern 222 and the third resonator pattern 232. In this embodiment, according to that, the first and second resonator patterns 212, 222, and the third and fourth resonator patterns 232, 242, are respectively coupled by the electric field with each other, and the second and third resonator patterns 222, 232 are coupled by only pure electric field.

Like this, in case that the coupling between the resonators is gained by only the pure electric field, an impedance inverter circuit between the resonators forms an inductance, therefore, one attenuation pole is provided at a position higher than the pass band. Accordingly, in the dielectric filter based on this embodiment, the coupling between the first and second resonator patterns 212, 222 and the coupling between the third and fourth resonator patterns 232, 242 can form a plurality of attenuation poles at a position lower than the pass band according to a field coupling quantity, and also, can form one attenuation pole at a position higher than the pass band by the field coupling between the second and third resonator patterns 222, 232. Therefore, the attenuation pole can be provided at the band higher or lower than the pass band.

As shown in FIG. 7, in the dielectric filter based on the third embodiment of the invention and on the upper face of the dielectric block 300 formed piercing through the upper and lower faces of the first through fourth resonators 310, 320, 330, 340, there are equipped the first through fourth resonator patterns 312, 322, 332, 342 and a pair of fifth metal patterns 372 formed, being distanced by a constant interval in both sides of the respective resonator patterns 312 through 342. On one side of each of the first and fourth resonator patterns 312, 342, each of the input and output electrode patterns 374, 376 individually connected to the input and output electrode (not shown) is formed, respectively.

The field coupling is formed between the second and third resonator patterns 322, 332 in this embodiment of the invention. In the dielectric filter of this embodiment, the coupling between the first and second resonator patterns 312, 322 and the coupling between the third and fourth resonator patterns 332, 342 are coupled by the electric field, and the second and third resonator patterns 322, 332 are coupled by only the pure electric field. In case there exists only the pure field coupling in the coupling between the resonators, the impedance inverter circuit between the resonators has one attenuation pole at a position lower than the pass band by a capacitance formation. Accordingly, in the dielectric filter based on this embodiment, the coupling between the first and second resonator patterns 312, 322 and the coupling between the third and fourth resonator patterns 332, 342 can form a plurality of attenuation poles at a position lower than the pass band according to the field coupling quantity, and also, can form one attenuation pole at a position lower than the pass band by the field coupling between the second and third resonator patterns 322, 332. Therefore, the attenuation pole can be provided at the band lower than the pass band.

As shown in FIG. 8, in the dielectric filter based on the fourth embodiment of the invention and on the upper face of the dielectric block 400 formed piercing through the upper and lower faces of the first through fourth resonators 410, 420, 430, 440, there are equipped the first through fourth resonator patterns 412, 422, 432, 442; a pair of sixth metal patterns 472 positioned, being distanced by a constant interval in both sides of the respective resonator patterns 412 through 442; and a seventh metal pattern 474 for partitioning off the opening part provided between the second and third resonator patterns 422, 432 by connecting centers of two sixth metal patterns 472 with each other. The metal pattern formed on the upper face of the dielectric block 400 in this embodiment is actually formed in the shape of "H". On one side of each of the first and fourth resonator patterns 412, 442, each of the input and output electrode patterns 476, 478 individually connected to the input and output electrode (not shown) is formed, respectively.

In this embodiment the field coupling occurs between the second resonator pattern 422 and the third resonator pattern 432. According to that, in the dielectric filter of this embodiment, the field coupling occurs between the first and second resonator patterns 412, 422 and between the third and fourth resonator patterns 432, 442, and only the pure field coupling occurs between the second and third resonator patterns 422, 432. Accordingly, the dielectric filter based on this embodiment has one attenuation pole at the position lower then the pass band.

The electric length of the pattern for coupling the resonators of the inventive dielectric filter is actually $\lambda/4$.

As afore-mentioned, in the inventive dielectric filter, the coupling between resonators influences not only the neighboring resonators but also the resonators positioned distantly because, by the metal patterns formed on the upper face of the dielectric block, all the resonators formed in the dielectric block are coupled with one another. Accordingly, an attenuation characteristic at the stop band is prominent, and in addition, there is an effect of an easy coupling between the resonators by changing a shape of the metal pattern.

Additionally, an attenuation pole is generated at a position higher or lower than a pass band without increasing the number of resonators, accordingly, a filter can be miniaturized and a characteristic for an insertion loss is improved by a reduction in the number of the resonators.

It will be apparent to those skilled in the art that various modifications and variations can be made in the present invention without deviating from the spirit or scope of the invention. Thus, it is intended that the present invention cover the modifications and variations of this invention provided they come within the scope of the appended claims and their equivalents.

What is claimed is:

1. A dielectric filter having a notch pattern comprising:

a dielectric block having a plurality of conductive surfaces, a non-conductive surface and first and second non-conductive portions extending from said non-conductive surface to one of said plurality of conductive surfaces;

a plurality of resonators formed in the dielectric block;

a plurality of electrically conductive patterns formed on said non-conductive surface and separated from one another by predetermined distances, said plurality of electrically conductive patterns including a plurality of metal patterns and a plurality of resonator patterns, said plurality of resonator patterns being connected to upper ends of the plurality of resonators, respectively, and distanced from one another to form a plurality of first opening parts which are respectively opened electrically between them, said plurality of metal patterns including, a first pattern formed on a center region of the non-conductive surface of the dielectric block so as to partition off one of said plurality of first opening parts, said first pattern extending from one side wall face of the dielectric block as a ground face to a portion of the non-conductive surface of the dielectric block; and a second pattern distanced by a given interval from one side of the plurality of resonator patterns, said given interval for forming a second opening part between the plurality of resonator patterns and the second pattern and forming a third opening part between the first pattern and the second pattern;

an input electrode formed on the first non-conductive portion extending from the non-conductive surface, said input electrode at a predetermined distance from a resonator of said plurality of resonators for receiving a signal to be provided to said resonator; and an output electrode formed on the second non-conductive portion extending from the non-conductive surface, said output electrode at a predetermined distance from a resonator of said plurality of resonators for outputting the filtered signal from the plurality of resonators.

2. The dielectric filter of claim 1, wherein said plurality of resonators are coupled by a notch pattern having an electric length that is $\lambda/4$ of a resonate frequency.

3. The dielectric filter of claim 1, wherein the plurality of metal patterns further includes a pair of patterns respectively distanced by a constant interval from both sides of the plurality of resonator patterns.

4. The dielectric filter of claim 1, wherein the plurality of metal patterns further includes: a pair of patterns respectively distanced by a constant interval from both sides of the plurality of resonator patterns; and another pattern formed on a center of said non-conductive surface, both end parts of said another pattern being individually connected to the pair of patterns, a pair of resonator patterns being positioned on both sides of said another pattern, each pair of resonator patterns being coupled by an electric field with each other.

5. The dielectric filter of claim 1, wherein a size of said first opening parts can be controlled so as to control an incline of a notch at a stop band higher than a pass band.

6. The dielectric filter of claim 1, wherein the plurality of metal patterns further includes:

a central pattern formed on the non-conductive surface of the dielectric block so as to partition off the plurality of resonators to a first side and a second side, both end parts of said central pattern being individually connected to both side wall faces of the dielectric block, respectively;

a pair of third patterns respectively distanced by a constant interval from both sides of the resonator patterns formed on said first side of the central pattern; and a pair of fourth patterns respectively distanced by the constant interval from both sides of the resonator patterns formed on said second side of the central pattern.

7. The dielectric filter of claim 6, wherein the plurality of metal patterns further includes a pair of fifth patterns respectively distanced by a constant interval from both sides of the plurality of resonator patterns.

8. The dielectric filter of claim 7, wherein the plurality of metal patterns further includes:

a pair of sixth patterns respectively distanced by a constant interval from both sides of the plurality of resonator patterns; and a seventh pattern formed on a center of said non-conductive surface, both end parts of said seventh pattern being individually connected to the pair of sixth patterns, a pair of resonator patterns being positioned on both sides of said seventh pattern, each pair of resonator patterns being coupled by an electric field with each other.

9. The dielectric filter of claim 6, wherein said central pattern cuts off an electric field coupling between the resonator patterns positioned on said first and second sides thereof, so that the resonator patterns positioned on said first side of the central pattern are coupled by electric field with each other and the resonator patterns positioned on said second side of the central pattern are coupled by electric field with each other.

10. The dielectric filter of claim 6, wherein said pair of third patterns and said pair of fourth patterns extend substantially perpendicular to said central pattern.

11. The dielectric filter of claim 1, wherein a size of said third opening part can be controlled so as to control an incline of a notch at the stop band lower than a pass band.

12. The dielectric filter of claim 1, wherein the plurality of metal patterns further includes:

an input electrode pattern distanced by a constant interval from one side of the plurality of resonators and connected to the input electrode to form an input capacitance at a gap with the input electrode; and an output electrode pattern distanced by the constant interval from another side of the plurality of resonators and connected to the output electrode to transfer a signal resonated in the resonators to the output electrode.

13. A dielectric filter having a notch pattern comprising:

a dielectric block having a plurality of conductive surfaces, a non-conductive surface and first and second non-conductive portions extending from said non-conductive surface to one of said plurality of conductive surfaces;

a plurality of resonators formed in the dielectric block;

a plurality of electrically conductive patterns formed on said non-conductive surface and separated from one another by predetermined distances, said plurality of electrically conductive patterns including a plurality of metal patterns and a plurality of resonator patterns, the plurality of metal patterns including, a pair of patterns respectively distanced by a constant interval from both sides of the plurality of resonator patterns; and another pattern formed on a center of said non-conductive surface, both end parts of said another pattern being individually connected to the pair of patterns, a pair of resonator patterns being positioned on both sides of said another pattern, each pair of resonator patterns being coupled by an electric field with each other;

an input electrode formed on the first non-conductive portion extending from the non-conductive surface, said input electrode at a predetermined distance from a resonator of said plurality of resonators for receiving a signal to be provided to said resonator; and an output electrode formed on the second non-conductive portion extending from the non-conductive surface, said output electrode at a predetermined distance from a resonator of said plurality of resonators for outputting the filtered signal from the plurality of resonators.

14. A dielectric filter having a notch pattern comprising:

a dielectric block having a ground face plated with conductive metal for all portions except a non-conductive upper face thereof and two non-conductive side portions of one side wall face connected to the upper face, a plurality of resonator patterns and a plurality of metal patterns plated with the conductive metal being formed on the non-conductive upper face, said plurality of resonator patterns being separated from said plurality of metal patterns by predetermined distances;

an input electrode provided on a first one of said two non-conductive side portions and formed so that a signal may be inputted thereto;

a plurality of resonators formed piercing through upper and lower faces of the dielectric block, lower end parts of said plurality of resonators being short-circuited on the ground face of the dielectric block, at least two resonators being connected with each other through one of said plurality of resonator patterns formed on the upper face of the dielectric block in order to resonate and wave-transfer a signal inputted through the input electrode; and an output electrode provided in a second one of said two non-conductive side portions of said one side wall face of the dielectric block, the output electrode for outputting a signal resonated in the plurality of resonators;

said plurality of metal patterns including, a central pattern formed on the upper face and connected to both plated side wall faces of the dielectric block so as to partition the plurality of resonators into two sides;

a first pair of patterns respectively distanced by a constant interval from both sides of the resonator patterns formed on one side of the central pattern; and a second pair of patterns respectively distanced by a constant interval from both sides of the resonator patterns formed on the other side of the central pattern.

15. A dielectric filter having a notch pattern comprising:

a dielectric block having a ground face plated with conductive metal for all portions except a non-conductive upper face thereof and two non-conductive side portions of one side wall face connected to the upper face, a plurality of resonator patterns and a plurality of metal patterns plated with the conductive metal being formed on the non-conductive upper face, said plurality of resonator patterns being separated from said plurality of metal patterns by predetermined distances;

an input electrode provided on a first one of said two non-conductive side portions and formed so that a signal may be inputted thereto;

a plurality of resonators formed piercing through upper and lower faces of the dielectric block, lower end parts of said plurality of resonators being short-circuited on the ground face of the dielectric block, at least two resonators being connected with each other through one of said plurality of resonator patterns formed on the upper face of the dielectric block in order to resonate and wave-transfer a signal inputted through the input electrode; and an output electrode provided in a second one of said two non-conductive side portions of said one side wall face of the dielectric block, the output electrode for outputting a signal resonated in the plurality of resonators said plurality of metal patterns further including, a pair of patterns respectively distanced by a constant interval from both sides of the plurality of resonator patterns; and another pattern formed on a center of said non-conductive surface, both end parts of said another pattern being individually connected to the pair of patterns, a pair of resonator patterns being positioned on both sides of said another pattern, each pair of resonator patterns being coupled by an electric field with each other.

16. A dielectric filter having a notch pattern comprising:

a dielectric block having a plurality of conductive surfaces, a non-conductive surface and first and second non-conductive portions extending from said non-conductive surface to one of said plurality of conductive surfaces;

a plurality of resonators formed in the dielectric block;

a plurality of electrically conductive patterns formed on said non-conductive surface and separated from one another by predetermined distances, said plurality of electrically conductive patterns including a plurality of metal patterns and a plurality of resonator patterns, the plurality of metal patterns including, a central pattern formed on the non-conductive surface of the dielectric block so as to partition off the plurality of resonators to a first side and a second side, both end parts of said central pattern being individually connected to both side wall faces of the dielectric block, respectively;

a first pair of patterns respectively distanced by a constant interval from both sides of the resonator patterns formed on said first side of the central pattern; and a second pair of patterns respectively distanced by the constant interval from both sides of the resonator patterns formed on said second side of the central pattern;

an input electrode formed on the first non-conductive portion extending from the non-conductive surface, said input electrode at a predetermined distance from a resonator of said plurality of resonators for receiving a signal to be provided to said resonator; and an output electrode formed on the second non-conductive portion extending from the non-conductive surface, said output electrode at a predetermined distance from a resonator of said plurality of resonators for outputting the filtered signal from the plurality of resonators.

* * * * *